United States Patent [19]

Kowal

[11] 4,280,235

[45] Jul. 28, 1981

[54] INSERTS FOR FLUID-TYPE MATTRESSES

[76] Inventor: Emil D. Kowal, 4925 Santa Anita Ave., Temple City, Calif. 91780

[21] Appl. No.: 124,767

[22] Filed: Feb. 26, 1980

[51] Int. Cl.[3] ..... A47C 27/08; B32B 31/00

[52] U.S. Cl. ..... 5/458; 5/451; 156/250; 156/256; 156/308.4

[58] Field of Search ..... 5/451, 458, 457, 452, 5/449; 156/250, 256, 308.4

[56] References Cited

U.S. PATENT DOCUMENTS

| | | | |
|---|---|---|---|
| 3,522,123 | 7/1970 | Marchant | 5/458 |
| 4,141,770 | 2/1979 | Mollura | 5/458 |
| 4,172,301 | 10/1979 | Everard et al. | 5/455 |

*Primary Examiner*—Roy D. Frazier
*Assistant Examiner*—Alexander Grosz
*Attorney, Agent, or Firm*—Donald Diamond

[57] ABSTRACT

A fluid-damping and shape-defining insert is provided for fluid-type mattresses such as water bed mattresses and air mattresses. The insert comprises a first flexible flange secured at its periphery to the upper boundary sheet of the mattress, a second flexible flange secured at its periphery to the lower boundary sheet of the mattress, and flexible damping means extending between the first and second flanges and secured thereto. In a particular embodiment, the damping means comprise first and second, perimetrically joined, flexible discs further defined by substantially opposing first and second central regions contiguous with an intermittently apertured, common peripheral region. The first and second central regions of the discs are centrally secured to the first and second flanges, respectively. This construction permits failure of the insert, if any, to occur at the interface of the discs and the flange rather than at the interface of the flange and the mattress boundary sheet, as a result of which, failure of the insert does not impair the fluid integrity of the mattress.

12 Claims, 6 Drawing Figures

INSERTS FOR FLUID-TYPE MATTRESSES

BACKGROUND OF THE INVENTION

This invention relates to fluid-type mattresses such as water bed mattresses and air mattresses and, more particularly, to fluid-damping and shape-defining inserts for use with such mattresses.

The construction of fluid-type mattresses from fluid impervious, flexible, thermoplastic sheeting, such as polyvinyl chloride sheeting having a thickness of at least about 20 mils, is well known in the prior art.

The prior art has also recognized the need for inserts to assist in maintaining the configuration of fluid-type mattresses by modulating fluid flow and limiting geometrical distortion during ordinary use of such mattresses.

Such inserts, which are generally constructed from the same or similar flexible material as that employed for the boundary sheets of the mattress, are secured, in opposing locations, to the inner surface of the upper and lower boundary sheets of the mattress. The inserts are loaded in tension upon the application of internal fluid pressure and, by extending across the fluid volume, impede the movement of fluid within the mattress.

The prior art as illustrated by U.S. Pat. No. 4,172,301 (Everard et al., 1979) and U.S. Pat. No. 4,167,432 (Mollura, 1979) as well as pages 82, 83, Industry Magazine, American National, September 1978, discloses that vertically apertured, flexible, cylindrical-type coils can be disposed within fluid-type mattresses and connected to the top and bottom sheets thereof for restricting wave motion and preventing the top boundary sheet of the mattress from rising. In such construction, the forces acting on the inserts are transmitted to relatively small regions in the mattress boundary sheet. A major disadvantage of this construction lies in the sensitivity to overload of the connection between the insert and the boundary sheet. As a result of repeated application of forces through ordinary use and momentary overload, failure can occur at such connection which renders the mattress unserviceable through breach of the fluid-impervious mattress sheet.

It is, therefore, an object of this invention to provide flow-damping and shape-defining inserts for fluid-type mattresses, such as water-bed mattresses, wherein the attachments of such inserts to the oppositely disposed, mattress boundary sheets are through extended-length seams.

Another object of this invention is to provide a fluid-type mattress insert comprising flexible damping means and oppositely disposed, flexible, enlarged flange means wherein the damping means are secured to the flange means by first seams and the flange means are secured to the oppositely disposed mattress sheets by second seams having greater peripheral length and strength than the first seams whereby forces acting on the insert will be accommodated by flexure or, in the limit, by failure at or about the first seam, leaving the mattress boundary sheets unimpaired.

SUMMARY OF THE INVENTION

In accordance with one aspect of this invention, there is provided a flow-damping and shape-defining insert for fluid-type mattresses such as water bed and air mattresses, which comprises, a first flexible flange secured at its periphery to the upper boundary sheet of the mattress, a second flexible flange secured at its periphery to the lower boundary sheet of the mattress in a location substantially opposite to the location of the first flexible flange, and damping means extending between the first and second flexible flanges and secured thereto. The damping means may advantageously take the form of a pair of perimetrically secured discs having intermittent peripheral apertures wherein the opposing central portions of the disc are secured to the oppositely disposed flanges such that the discs assume an eliptical or cylindrical configuration in the fluid engaging, deployed position.

In accordance with a second aspect of this invention, there is provided a method for construction flow-damping and shape-defining inserts for fluid-type mattresses, which comprises: forming first and second similar flanges and first and second similar discs from flexible, heat sealable, fluid impervious material; superimposing the first and second discs and sealing the perimetrical edges thereof to form a conjoint seam, with the joined discs being further defined by substantially opposing central regions contiguous with a common peripheral region; removing portions of the material from the common peripheral region to provide intermittent apertures therein; sealing the central regions of the first and second discs to the first and second flanges, respectively; and sealing the perimetrical edges of the first and second flanges to the inner surfaces of the upper and lower mattress boundary sheets, respectively.

DETAILED DESCRIPTION

Figure 1:
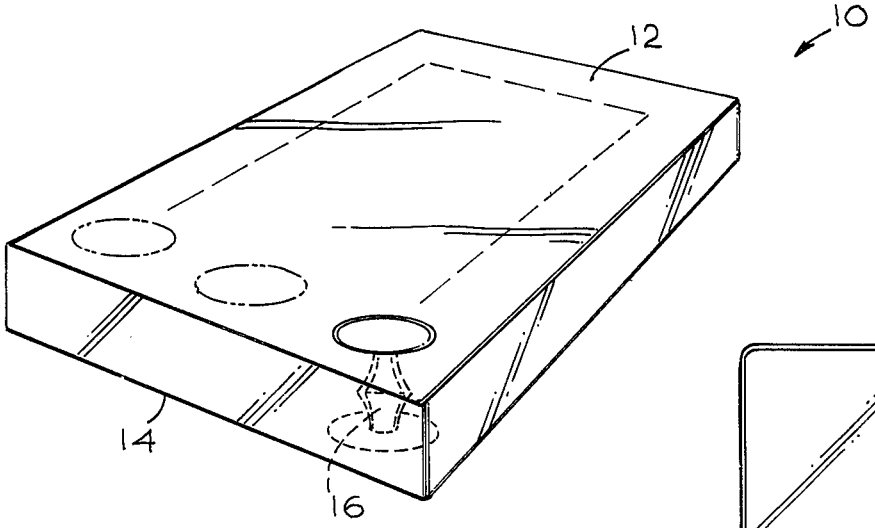
FIG. 1 is a perspective and partly schematic view of a water bed mattress embodying a plurality of flow-damping and shape-defining inserts of the present invention.
Figure 2:
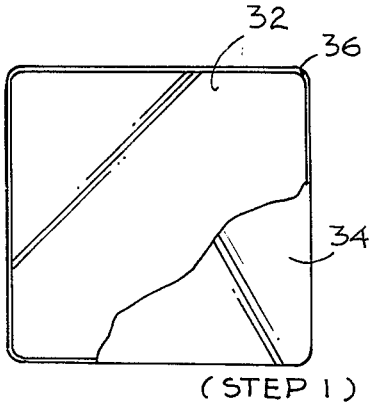
FIG. 2 is a top view showing superimposed, perimetrically sealed discs of quadrilateral configuration created in the first step of constructing an insert of the present invention, with a fragmented section of the upper disc removed to show the lower disc.

Referring now to the drawings, FIG. 1 shows a water bed mattress 10 defined by an upper boundary sheet 12, a lower boundary sheet 14 and side panels integrated with these sheets. A plurality of fluid-damping and shape-defining inserts 16 interconnect the lower boundary sheet 14 with the upper boundary sheet 12 in such a manner as to ensure a level and well-supported alignment for the upper boundary sheet when the mattress is fully charged with water. In this construction, the inserts 16 fulfill a dual role in that they provide geometric support for the mattress and act as dampers to modulate fluid flow whereby wave motion in the mattress, during ordinary use, is attenuated.

Figure 4:
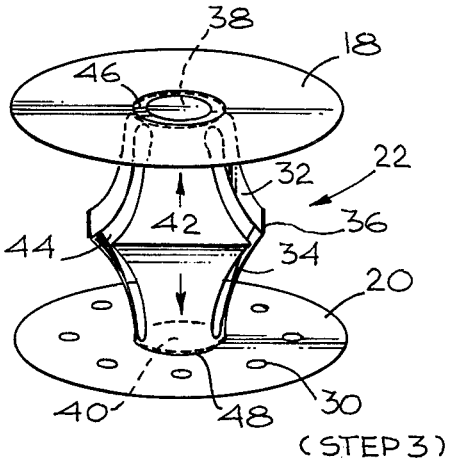
FIG. 4 is a perspective view of an insert of the present invention in an expanded position showing the perimetrically sealed disc extending between and secured to oppositely disposed flanges.
Figure 5:
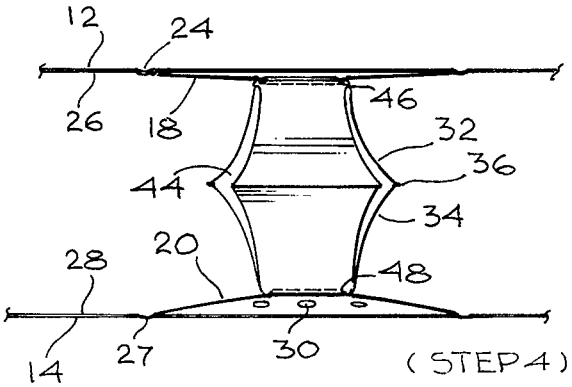
FIG. 5 is a sectional view, in elevation, of a fluid-type mattress showing the insert of FIG. 4 deployed therein with the oppositely disposed flanges secured to the oppositely disposed mattress sheets.

As shown in FIGS. 4 and 5, the insert 16 comprises a first flexible flange 18, a second flexible flange 20 and damping means 22 extending between and secured to these flanges. The first flange 18 is secured at its perimetrical edge 24 to the inner surface 26 of the upper boundary sheet 12 and the second flange 20 is secured at its perimetrical edge 27 to the inner surface 28 of the lower boundary sheet 14 in a location substantially opposite to the location of the first flange. The flanges 18, 20 are advantageously disposed in abutting relationship to their respective boundary sheets 12, 14 with their perimetrical edges 24, 27 heat sealed to the sheets to form high strength lap welds. While the flanges, as shown, have a circular perimeter, any suitable configuration can be used. The non-sealed, peripheral area of the second flange may advantageously be provided with relatively small perforations 30 to permit fluid communication between the internal volume of the mattress and the portions of the lower boundary sheet covered by the second flange and thereby facilitate heat transfer within the mattress from a heat source disposed below the mattress.

The damping means 22, disposed between and secured to the first and second flanges, comprises a first flexible disc 32 superimposed upon a second flexible disc 34 with their perimetrical edges being joined, by heat sealing, to form a conjoint seam 36. The perimetrically joined discs are further defined by first 38 and second 40 opposing central regions and a common peripheral region 42 extending between and continguous with the central regions. The first and second discs are secured to the first and second flanges by heat seals of annular or any other suitable configuration which define the perimeters of the central regions.

The peripheral region 42 of the perimetrically joined discs is provided with aperture means in the form of a plurality of spaced cut-outs 44 which traverse the conjoint seam 36 of the discs. When the perimetrically joined discs are in proximate relationship, the cut-outs have V-like configurations with the divergent walls thereof originating at the conjoint seam and converging into arcuate apexes located near the periphery of the central regions of the disc. The number of cut-outs, the configuration thereof and the spacing therebetween should be so selected as to modulate fluid flow and limit geometric distortion while maintaining appropriate strength of the insert. With respect to effective cut-out patterns, four cut-outs are shown in FIG. 3 while eight cut-outs are shown in FIG. 3A.

The construction of the flow-damping and shape-defining insert of the invention can be undertaken by forming first and second similar flanges and first and second similar discs from flexible, fluid impervious, heat sealable material as, for example, by cutting the flanges and discs, in a circular or quadrilateral configuration or in any other suitable shape, from thermoplastic sheeting of appropriate thickness. Suitable thermoplastic sheeting includes vinyl sheeting exemplified by polyvinyl chloride film which is a typical heat sealable material used in the fabrication of water bed mattresses.

Figure 3:
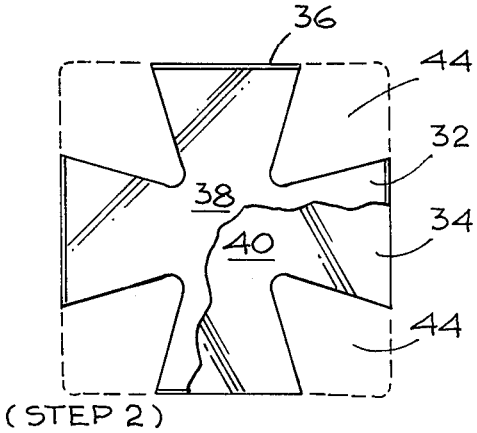
FIG. 3 is a view of the perimetrically sealed discs of FIG. 2 showing four, spaced, cut-out portions traversing the peripheral region thereof.
Figure 3A:
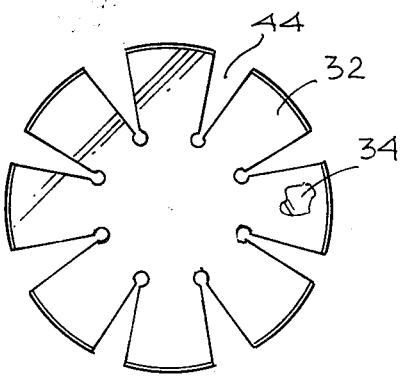
FIG. 3A is a plan view of perimetrically sealed discs of circular configuration showing eight, spaced, cut-out portions transversing the peripheral region thereof.

The first and second square-shaped discs 32, 34 are positioned in superimposed relationship and heat sealed along their perimetrical edges to form a conjoint seam 36, as shown in FIG. 3. The perimetrically joined discs are further defined by opposing central regions 38, 40 contiguous with a common peripheral region 42.

Conical or wedge shaped portions of material are cut and removed from the common peripheral region 42 of the perimetrically joined discs to form substantially equispaced fluid flow apertures 44 which, advantageously, traverse the conjoint seam 36 of the discs. Four apertures are shown in the square discs illustrated in FIG. 3 while eight apertures are depicted in the circular discs illustrated in FIG. 3A.

The central regions 38,40 of the first and second discs 32, 34 are positioned in abutting relationship to the central portions of the first and second flanges 18, 20, respectively, and heat sealed to the respective flanges by annular sealing rings 46, 48 which define the perimeters of the central regions, as shown in FIG. 4. The peripheral area of the second flange 20 exterior to the interface of the disc and the flange may be provided with a plurality of small, cut or punched, perforations 30 so as to provide heat transfer, fluid communication between the interior of the mattress and the portions of the lower mattress sheet covered by the perforated portions of the second flange(s).

The first and second flanges are then positioned in abutting relationship to the inner surfaces 26, 28 of the upper and lower mattress boundary sheets, 12, 14, respectively, in substantially oppositely disposed locations, and the perimetrical edges 24, 27 of the flanges are heat sealed to the adjacent boundary sheets to thereby complete the construction and installation of the flow-damping and shape-defining insert. The combination of the abutting relationship and peripheral seal of the first flange to the upper mattress sheet provides a composite structure of enhanced strength.

The peripheral length of the perimetrical seals 24, 27 of the first and second flanges are substantially greater than the peripheral lengths of the annular seals 46, 48, which interconnect the central regions of the joined discs to the flanges. As a result of this construction, forces acting on the damping element will be transmitted through seals 46 and 24 and through corresponding seals 48 and 27. Since the inner seals 46 and 48 are shorter in peripheral length and have less load transmitting ability than the outer seals 24 and 27, any failure, partial or total, will be initiated at the innerface between the disc central region and the flange rather than at the innerface between the flange and the mattress boundary sheet.

The fail-safe nature of the connection of the flange with the boundary sheet is a significant advantage of the insert of the invention, since a partial failure, or even a total failure, in one or more of the damping elements in the complete water bed mattress will not impair the general utility of the mattress. This feature is in contradistinction to the baffled water bed mattresses of the prior art wherein the damping element is directly connected to the mattress boundary sheet and any failure at or about the interconnecting seal necessarily impairs the fluid integrity of the mattress.

A principal feature of this invention resides in the deployment of flanges adjacent to the inner surfaces of the mattress boundary sheets, with the damping and shape-defining element being attached to the flanges. The size and detailed construction of the damping element may range from a simple sheet extending between the flanges to a more complex, apertured structure.

While in the foregoing description and accompanying drawings there has been shown and described the preferred embodiment of this invention, it will be understood, of course that minor changes may be made in the details of construction as well as in the combinations and arrangement of parts without departing from the spirit and scope of the invention as claimed.

That which is claimed is:

1. In a fluid-type mattress having upper and lower boundary sheets with each of said sheets being defined by inner and outer surfaces, an improved flow damping and shape-defining insert comprising:

a first flexible flange sealed at its periphery to the inner surface of the upper boundary sheet;

a second flexible flange sealed at its periphery to the inner surface of the lower boundary sheet in a location substantially opposite to the location of the first flexible flange; and damping means extending between the first and second flexible flanges and sealed thereto;

wherein the seals between the damping means and the flanges are more easily rupturable than the seals between the flanges and the mattress boundary sheets.

2. The insert of claim 1 wherein the peripheries of first and second flexible flanges are sealed to the upper and lower boundary sheets, respectively, by lap seals.

3. The insert of claim 2 wherein the first and second flexible flanges, within the boundaries of their respective lap seals, are in abutting relationship with the upper and lower boundary sheets, respectively.

4. The insert of claim 3 wherein the first and second flexible flanges have substantially circular configurations.

5. The insert of claim 3 wherein the second flexible flange, within the boundary defined by the lap seal, is provided with fluid flow perforation means.

6. The insert of claim 1 wherein the damping means comprise first and second superimposed flexible discs having a conjoint perimetrical seam and being further defined by substantially opposing central regions contiguous with a common peripheral region, said first disc being sealed at its central region to the first flexible flange, said second disc being sealed at its central region to the second flexible flange, and aperture means traversing said peripheral region.

7. The insert of claim 6 wherein the central regions of the first and second disc are sealed to the first and second flanges, respectively, by annular seals which define the perimeters of said central regions.

8. The insert of claim 6 wherein the aperature means comprise a plurality of cut-outs in spaced relationship.

9. The insert of claim 8 wherein the cut-outs traverse the conjoint perimetrical seam of said discs.

10. The insert of claim 9 wherein the cut-outs are substantially equispaced and have V-like configurations with the walls thereof diverging in a direction away from said central regions when the discs are in proximate relationship.

11. The insert of claim 10 wherein the number of cut-outs is four.

12. A method for constructing damping and shape-defining inserts for fluid-type mattresses having upper and lower boundary sheets with each of said sheets being defined by inner and outer surfaces, said method comprising:

forming first and second similar flanges and first and second similar discs from flexible, fluid impervious, heat sealable material;

superimposing the first and second discs and sealing the perimetrical edges thereof to form a conjoint seam, said perimetrically joined discs being further defined by substantially opposing central regions contiguous with a common peripheral region;

removing portions of material from the common peripheral region to form fluid flow cut-outs which traverse the conjoint seam;

sealing the central regions of the first and second discs to the first and second flanges, respectively; and sealing the perimetrical edges of the first and second flanges to the inner surfaces of the upper and lower boundary sheets, respectively.

* * * * *